US011602934B2

(12) United States Patent
Nakagawa et al.

(10) Patent No.: US 11,602,934 B2
(45) Date of Patent: Mar. 14, 2023

(54) LIQUID EJECTION HEAD, LIQUID EJECTION APPARATUS, AND LIQUID EJECTION METHOD

(71) Applicant: CANON KABUSHIKI KAISHA, Tokyo (JP)

(72) Inventors: Yoshiyuki Nakagawa, Kawasaki (JP); Kazuhiro Yamada, Yokohama (JP); Takuro Yamazaki, Inagi (JP); Toru Nakakubo, Kawasaki (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/719,189

(22) Filed: Dec. 18, 2019

(65) Prior Publication Data

US 2020/0198342 A1 Jun. 25, 2020

(30) Foreign Application Priority Data

Dec. 19, 2018 (JP) ..... JP2018-237195

(51) Int. Cl.
*B41J 2/14* (2006.01)
*B41J 2/045* (2006.01)

(52) U.S. Cl.
CPC ..... *B41J 2/1404* (2013.01); *B41J 2/04586* (2013.01); *B41J 2/14145* (2013.01)

(58) Field of Classification Search
CPC .. B41J 2/1404; B41J 2/04586; B41J 2/14145; B41J 2002/0055; B41J 2/005
See application file for complete search history.

(56) References Cited

U.S. PATENT DOCUMENTS

| | | | | |
|---|---|---|---|---|
| 7,029,085 | B2 * | 4/2006 | Yokouchi | B41J 2/04573 347/11 |
| 9,085,144 | B2 | 7/2015 | Nakagawa et al. | |
| 10,040,290 | B2 | 8/2018 | Okushima et al. | |
| 10,300,707 | B2 | 5/2019 | Nakakubo et al. | |
| 10,421,287 | B2 | 9/2019 | Yamazaki et al. | |
| 10,434,773 | B2 | 10/2019 | Sameshima | |
| 10,538,087 | B2 | 1/2020 | Nakagawa et al. | |
| 10,576,741 | B2 | 3/2020 | Hammura et al. | |

(Continued)

FOREIGN PATENT DOCUMENTS

| | | |
|---|---|---|
| JP | 11-240179 A | 9/1999 |
| JP | 2002-355973 A | 12/2002 |

(Continued)

OTHER PUBLICATIONS

Office Action dated Oct. 25, 2022, in Japanese Patent Application No. 2018-237195.

*Primary Examiner* — Thinh H Nguyen
(74) *Attorney, Agent, or Firm* — Venable LLP

(57) ABSTRACT

A liquid ejection head, a liquid ejection apparatus, and a liquid ejection method are capable of sufficiently suppressing the thickening of a liquid in an ejection orifice. The liquid ejection head includes a pressure chamber, a channel in which a liquid is caused to flow through the pressure chamber, an ejection orifice communicating with the pressure chamber, and an ejection energy generation element configured to eject the liquid in the pressure chamber from the ejection orifice. A meniscus of the liquid is formed at an end portion of the ejection orifice communicating with the pressure chamber.

12 Claims, 6 Drawing Sheets

(56) References Cited

U.S. PATENT DOCUMENTS

| | | | | |
|---|---|---|---|---|
| 10,717,273 | B2 | 7/2020 | Nakagawa et al. | |
| 2013/0155152 | A1* | 6/2013 | Govyadinov ..... | B01L 3/502715 347/54 |
| 2018/0056651 | A1* | 3/2018 | Fukuda ..... | B41J 2/16526 |
| 2018/0370230 | A1 | 12/2018 | Nakagawa et al. | |
| 2019/0009554 | A1 | 1/2019 | Nakagawa | |
| 2019/0315123 | A1 | 10/2019 | Nakakubo | |

FOREIGN PATENT DOCUMENTS

| | | | |
|---|---|---|---|
| JP | 2017-177437 | A | 10/2017 |
| WO | 2017/130695 | A1 | 8/2017 |

* cited by examiner

LIQUID EJECTION HEAD, LIQUID EJECTION APPARATUS, AND LIQUID EJECTION METHOD

BACKGROUND OF THE INVENTION

Field of the Invention

The present invention relates to a liquid ejection head, a liquid ejection apparatus, and a liquid ejection method for ejecting a liquid such as ink.

Description of the Related Art

In inkjet print heads, for example, which eject liquid ink, as liquid ejection heads, a volatile component in the ink may possibly evaporate from the ejection orifices from which to eject the ink and thereby thicken the ink in the ejection orifices. Such thickening of the ink changes the ink ejection speed and so on and may cause ejection failures including a deterioration in ink landing accuracy. In particularly, in a case where no ink ejection operation has been performed for a prolonged period of time, the increase in ink viscosity is so significant that solid components in the ink are fixedly attached to the inside of the ejection orifices. This increases the ink flow resistance and accordingly increases the likelihood of ink ejection failures.

Japanese Patent Laid-Open No. 2002-355973 discloses a configuration in which each ejection orifice communicates with a circulation channel through which ink is circulated, and the ink flow is caused to enter the ejection orifice to make it more difficult for the ink in the ejection orifice to thicken.

SUMMARY OF THE INVENTION

A liquid ejection head of the present invention comprises: a pressure chamber; a channel in which a liquid is caused to flow through the pressure chamber; an ejection orifice communicating with the pressure chamber; and an ejection energy generation element configured to eject the liquid in the pressure chamber from the ejection orifice. The ejection orifice is such that a meniscus of the liquid is formed at an end portion of the ejection orifice communicating with the pressure chamber.

Further features of the present invention will become apparent from the following description of exemplary embodiments with reference to the attached drawings.

DESCRIPTION OF THE EMBODIMENTS

However, in the configuration disclosed in Japanese Patent Laid-Open No. 2002-355973, it is difficult for the ink flow to enter each ejection orifice to near its opening portion that is open to the outside. This makes it difficult to sufficiently suppress the thickening of ink near the opening portion. In particular, in a case where the speed of the circulatory flow is low, it is likely that the thickening of most part of the ink in the ejection orifice cannot be suppressed.

An object of the present invention is to provide a liquid ejection head, a liquid ejection apparatus, and a liquid ejection method capable of sufficiently suppressing the thickening of a liquid in an ejection orifice.

Embodiments of the present invention will be described below with reference to the drawings.

First Embodiment

Figure 1A:
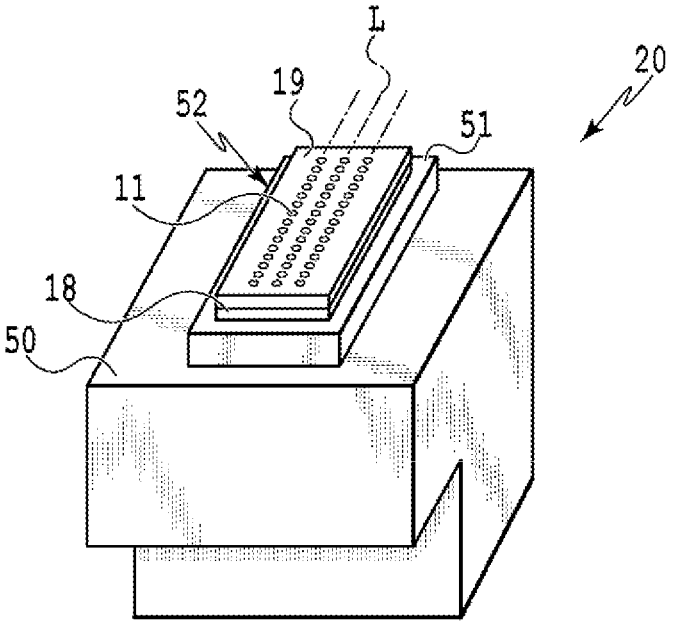
FIG. 1A is an explanatory diagram of a liquid ejection head in a first embodiment of the present invention.
Figure 1B:
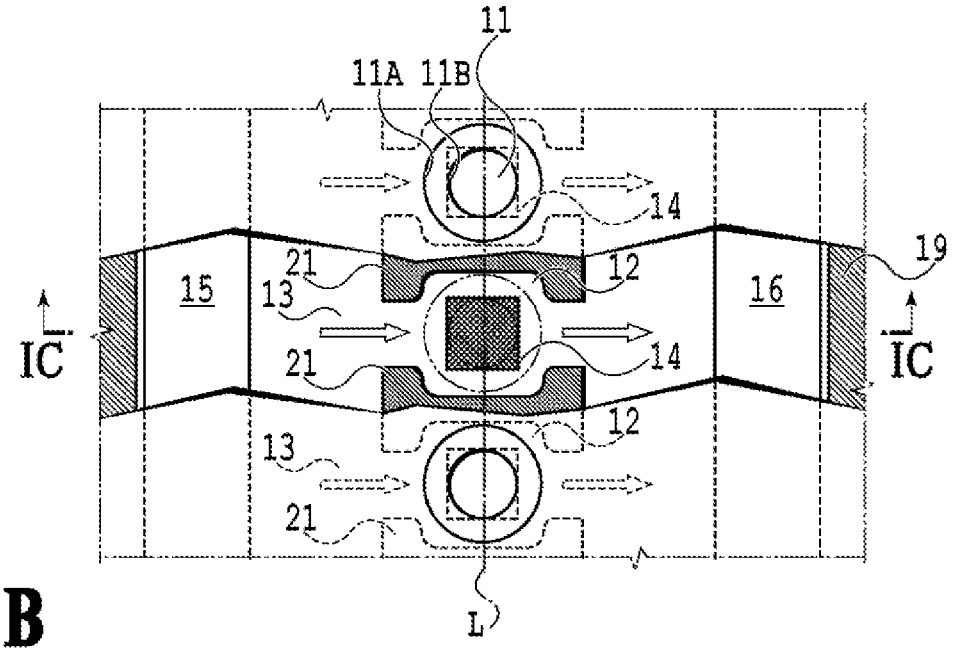
FIG. 1B is an explanatory diagram of the liquid ejection head in the first embodiment of the present invention.
Figure 1C:
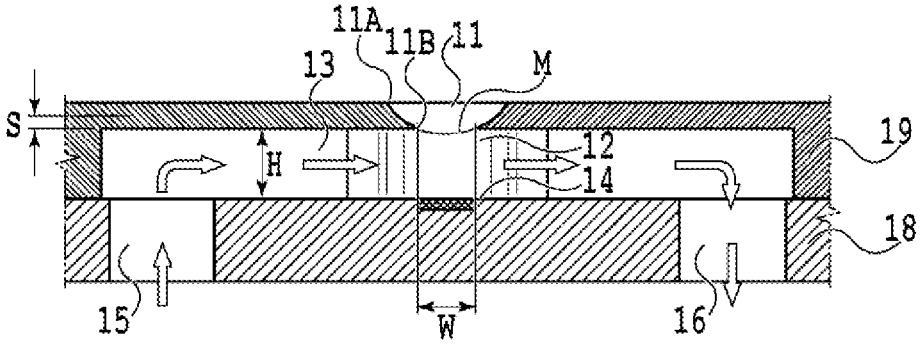
FIG. 1C is an explanatory diagram of the liquid ejection head in the first embodiment of the present invention.
Figure 2A:
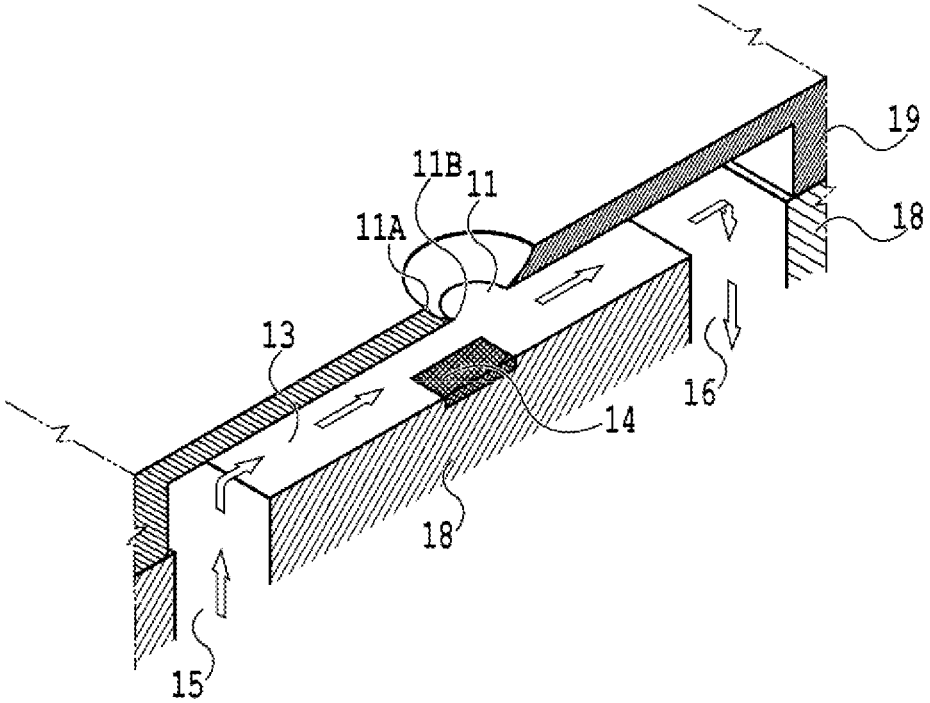
FIG. 2A is an explanatory diagram of the flow of ink in the liquid ejection head.

FIG. 1A is a schematic perspective view for explaining an inkjet print head 20 that ejects ink (liquid) as a liquid ejection head in a first embodiment of the present invention. A connecting member 51 and a printing element 52 are provided on a head main body 50. An orifice plate 19 in which a plurality of ejection orifices 11 are formed is provided on a substrate 18 of the printing element 52. The plurality of ejection orifices 11 form ejection orifice arrays L. FIG. 1B is an enlarged plan view of the printing element 52 with the orifice plate 19 partly cut out, and FIG. 1C is a cross-sectional view along line IC-IC in FIG. 1B. FIG. 2A is a perspective view of a cross section along line IC-IC in FIG. 1B.

Between the substrate 18 and the orifice plate 19, there are formed: pressure chambers 12 which are separated from each other by partitions 21 and each of which corresponds to one of the ejection orifices 11; and channels 13 in which ink is caused to flow through these pressure chambers 12. Thus, a plurality of pressure chambers 12 are provided along each ejection orifice array. One side of each channel 13 communicates with a supply channel 15 penetrating through the substrate 18, while the other side of the channel 13 communicates with an outlet channel 16 penetrating through the substrate 18. Ink is externally supplied through the supply channel 15 and caused to flow out through the outlet channel 16. In the present embodiment, the ink caused to flow out from the outlet channel 16 is returned to the supply channel 15 to be circulated, so that an ink circulatory flow as shown by arrows in the drawings is formed through the channel 13. Specifically, ink is circulated between the inside and outside of the pressure chamber 12.

Each ejection orifice 11 in the present embodiment is circular in cross section, and the inner diameter of its opening end 11A open to the outside (hereinafter also referred to as "top 11A") is larger than the inner diameter of its opening end 11B open to the inside of the pressure chamber 12 (hereinafter also referred to as "bottom 11B"). Also, the inner surface between these top 11A and bottom 11B is curved in such a direction as to become larger in diameter. In other words, the inner surface of the ejection orifice 11 is in what is called a mortar shape. In the present embodiment, a height H (see FIG. 1C) of the channel 13 on the upstream side of the bottom 11B of the ejection orifice 11 in the ink flow direction is 50 μm or smaller. A width W (see FIG. 1C) of the bottom 11B of the ejection orifice 11 in the ink flow direction is 40 μm or smaller. Moreover, the length of the ejection orifice 11, which corresponds to the thickness of the orifice plate 19, is 5 μm or larger.

Water repellent treatment has been performed on the inner surface of the ejection orifice 11. The water repellent treatment is performed by, for example, attaching a fluorine compound, which contains fluorine, to the inner surface or by forming the inner surface from a fluorine compound. With the water repellency of the inner surface of the ejection orifice 11, a meniscus M (interface) of the ink at the ejection orifice 11 is formed at an end portion of the ejection orifice 11 communicating with the pressure chamber 12, as shown in FIG. 1C. The end portion of the ejection orifice 11 at which the meniscus M is formed covers the bottom 11B of the ejection orifice 11 and a position inside the ejection orifice 11 near the bottom 11B (e.g., the 2-μm position from the bottom 11B). As will be described later, the meniscus M will be formed at the top 11A if no water repellent treatment has been performed on the inner surface of the ejection orifice 11. That the inner surface of the ejection orifice 11 is in a mortar shape and this inner surface faces toward the outside (the upper side in FIG. 1C) makes it easier to perform the water repellent treatment on the inner surface and is effective in enhancing the efficiency of the process.

The degree of water repellency to be given to the inner surface of the ejection orifice 11 is set according to the type and characteristics of the ink. The entirety or part of the inner surface of the ejection orifice 11 may be made water repellent. Also, the upper surface of the orifice plate 19 around the top 11A of the ejection orifice 11 may be made water repellent as well. Also, the orifice plate 19 itself may be formed from a water repellent material. In sum, it suffices that the meniscus M is formed at the end portion of the ejection orifice 11 communicating with the pressure chamber 12. In a case where the amount of entry by which the meniscus M formed at the bottom 11B of the ejection orifice 11 enters the ejection orifice 11 is 0 μm, the position where the meniscus M is formed is desirably set such that the amount of entry is in a range S of 0 μm to 3 μm (see FIG. 1C). A more preferable amount of entry is in the range of 0 μm to 2 μm. The following description will be given on the assumption that the meniscus M is formed at the bottom of the ejection orifice 11 (the amount of entry is 0 μm).

In the substrate 18, electrothermal conversion elements (heaters) 14 are provided as ejection energy generation elements that generate energy for ejecting the ink in the pressure chambers from the ejection orifices 11. Each heater 14 is driven to generate heat in a state where ink is circulated and the meniscus M is formed at the bottom of the ejection orifice 11. With the heater 14 driven to generate heat and thus forming a bubble in the ink in the pressure chamber 12, the ink is ejected from the ejection orifice 11 with the bubble forming energy. The ejection energy generation element is not limited to the heater 14 as in the present embodiment, but a piezoelectric element or the like can be used instead.

Also, the supply channel 15 and the outlet channel 16 in the present embodiment extend in a direction crossing the channel 13 (the up-down direction in FIG. 1B) so as to communicate with a plurality of pressure chambers 12 as a common supply channel and a common outlet channel. However, a plurality of supply channels 15 and a plurality of outlet channels 16 may be provided so as to respectively communicate with the plurality of pressure chambers 12. Also, the shapes of the ejection orifices 11 and the heaters 14 and the positional relation between them are not limited. For example, the heaters 14 may be rectangular in plan view.

The flow speed of ink in each channel (circulation speed) is set at such a speed that an ink ejection operation can be performed during ink circulation at that speed. For example, by setting the ink flow speed at 0.1 to 100 mm/s, an ink ejection operation can be executed in a state where the meniscus M of ink is formed at the bottom 11B of the ejection orifice 11, as shown in FIG. 1C. As for the method of generating the ink circulatory flow, a method utilizing a pressure difference, a micropump method utilizing heat or an electric field, or the like can be employed.

Figure 2B:
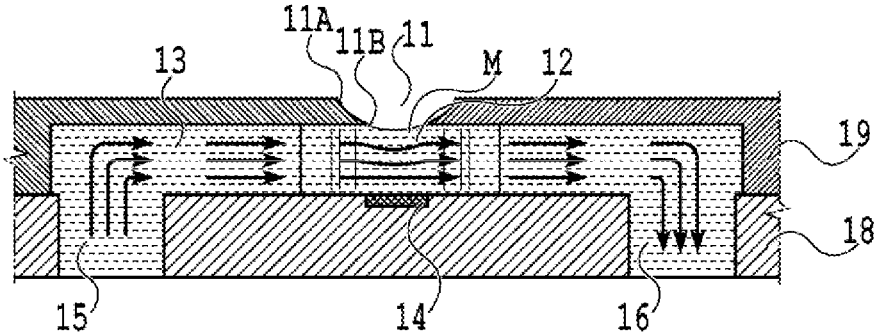
FIG. 2B is an explanatory diagram of the flow of ink in the liquid ejection head.

FIG. 2B is an explanatory diagram of the relation between the ink circulatory flow and the degree of ink concentration in the state where the meniscus M is formed at the bottom 11B of the ejection orifice 11.

In the ejection orifice 11, ink concentrated and thus thickened by the evaporation of its volatile component from the top 11A of the ejection orifice 11 is affected by the flow of ink circulated through the pressure chamber 12, as shown by an arrow in FIG. 2B. In the ejection orifice 11, ink is present at a position near the pressure chamber 12, that is, a position near the bottom 11B where the ink circulatory flow easily enters, and ink is not present at a position far from the pressure chamber 12, that is, a position near the top 11A where the ink circulatory flow does not easily enter. In this way, the ink circulatory flow reliably suppresses the thickening of ink in the ejection orifice 11. Hence, the thickening of ink due to the concentration thereof is suppressed even in a case where the ink circulation speed is low (e.g., lower than 1 mm/s). As a result, the desired ink ejection performance of the print head 20 is maintained, thereby enabling printing of a high-quality image without color misregistration or the like.

Meanwhile, for an ink containing a high concentration of a solid component, evaporation of its volatile component concentrates the ink to such a great extent that the circulation speed drops due to the high concentration of the solid component in the case of circulating such ink by the method utilizing a pressure difference, the micropump method, or the like. In particular, even in a case of circulating an ink with a high concentration (e.g., an ink containing 8 wt % or more of a solid component) at low speed, the present embodiment suppresses the thickening of the ink.

Figure 3A:
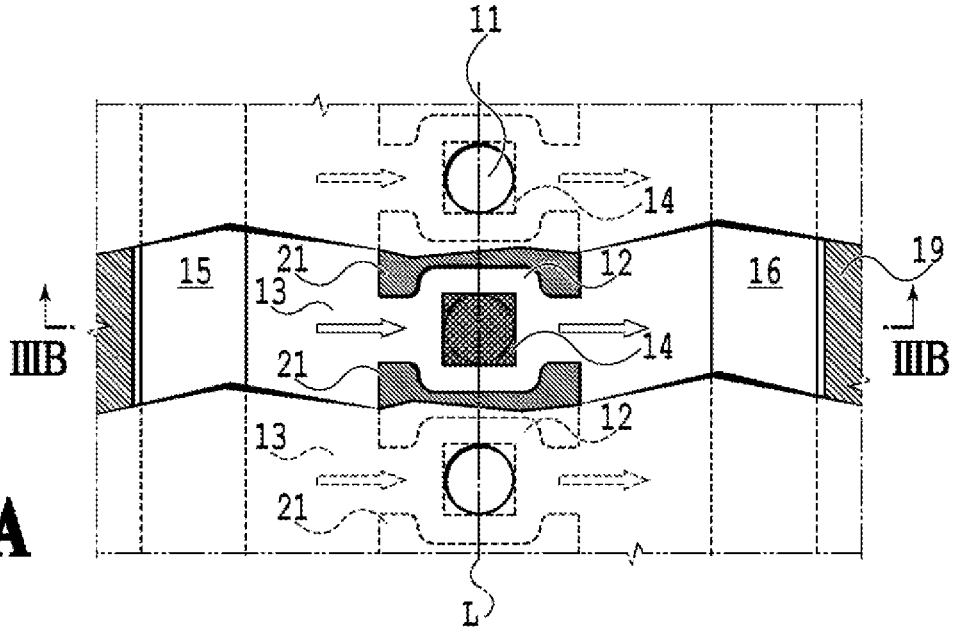
FIG. 3A is an explanatory diagram of the flow of ink in a liquid ejection head as a comparative example.
Figure 3B:
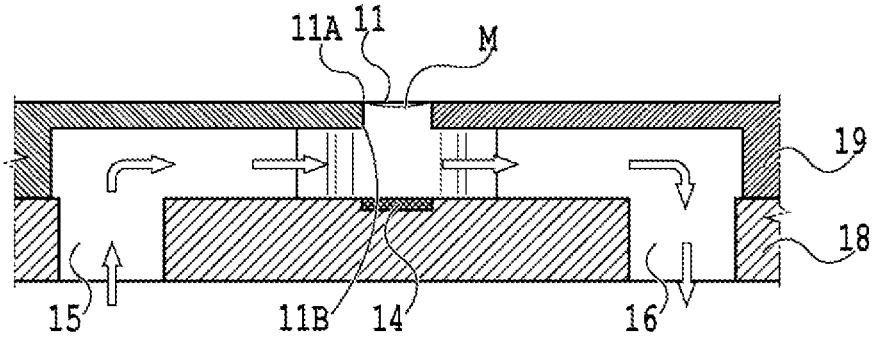
FIG. 3B is an explanatory diagram of the flow of ink in the liquid ejection head as the comparative example.
Figure 3C:
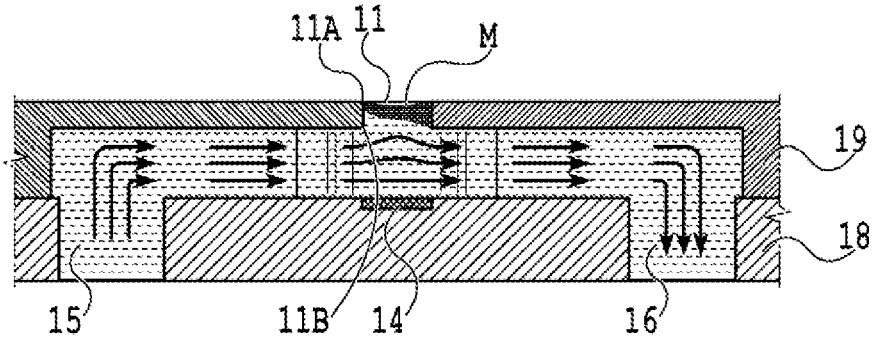
FIG. 3C is an explanatory diagram of the flow of ink in the liquid ejection head as the comparative example.

FIGS. 3A to 3C are explanatory diagrams of an inkjet print head as a comparative example with no water repellent treatment performed on the inner surfaces of any ejection orifices 11. FIG. 3A is an enlarged plan view corresponding to FIG. 1B, and FIG. 3B is a cross-sectional view along line IIIB-IIIB in FIG. 3A. In this comparative example, the meniscus M of ink is formed at the top 11A of each ejection orifice 11, as shown in FIG. 3B, since no water repellent treatment has been performed on the inner surface of the ejection orifice 11.

FIG. 3C is an explanatory diagram of the relation between the ink circulatory flow and the degree of ink concentration in this comparative example. In the ejection orifice 11 in this comparative example, ink is present up to the position of the top 11A, up to which the ink circulatory flow does easily enter, and the part of the ink concentrated and thus thickened by the evaporation of its volatile component from the top 11A (the black part in FIG. 3C) is not easily affected by the ink circulatory flow. In other words, it is difficult to suppress the thickening of ink due to the fact that ink is present up to the position of the top 11A of the ejection orifice 11, up to where the ink flow does not easily enter, and that the thickened ink makes it difficult for the ink flow to get deep inside the ejection orifice 11. It is extremely difficult to suppress the thickening of ink particularly in the case where the ink circulation speed is low (e.g., lower than 1 mm/s).

Other Embodiments

FIGS. 4A to 4E are explanatory diagrams of example configurations of ejection orifices 11 in other embodiments of the present invention. FIGS. 4A to 4E are cross-sectional views corresponding to FIG. 1C.

Figure 4A:
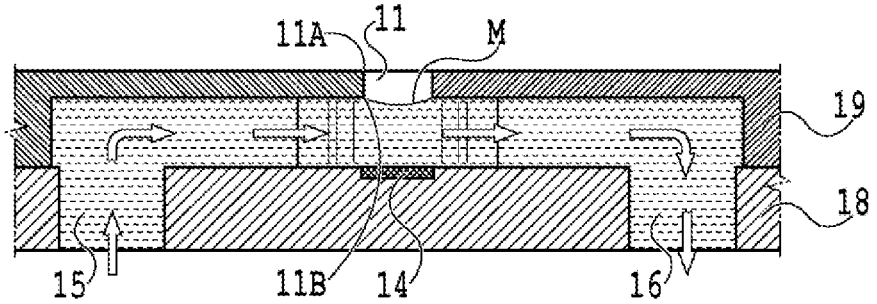
FIG. 4A is an explanatory diagram of an example configuration of an ejection orifice in another embodiment of the present invention.
Figure 4B:
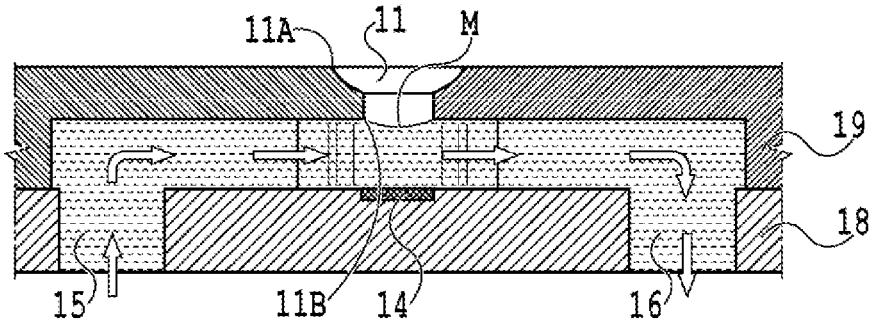
FIG. 4B is an explanatory diagram of an example configuration of an ejection orifice in another embodiment of the present invention.

The ejection orifice 11 in the embodiment of FIG. 4A is such that its inner surface is in a straight cylindrical inner surface shape. With the water repellency of the inner surface, a meniscus M is formed at a bottom 11B of the ejection orifice 11. The ejection orifice 11 in the embodiment of FIG. 4B is such that a part on its top 11A side is in a mortar shape similar to that in the first embodiment, and a part on its bottom 11B side is in a straight cylindrical inner surface shape similar to that in the embodiment of FIG. 4A. In this embodiment, the orifice plate 19 is formed of two members, one in which the part on the top 11A side is formed and the other in which the part on the bottom 11B side is formed. With the water repellency of the inner surface of the ejection orifice 11, a meniscus M is formed at the bottom 11B of the ejection orifice 11.

Figure 4C:
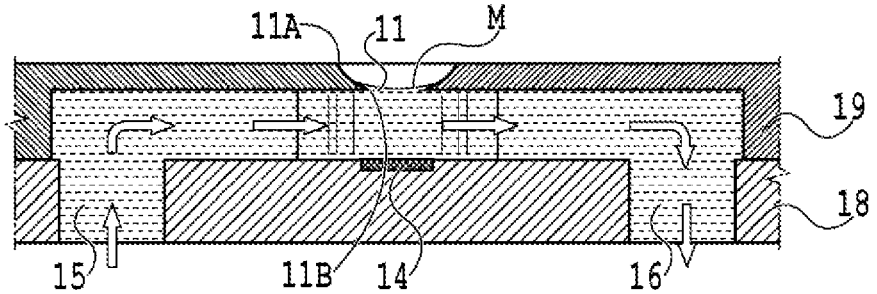
FIG. 4C is an explanatory diagram of an example configuration of an ejection orifice in another embodiment of the present invention.
Figure 4D:
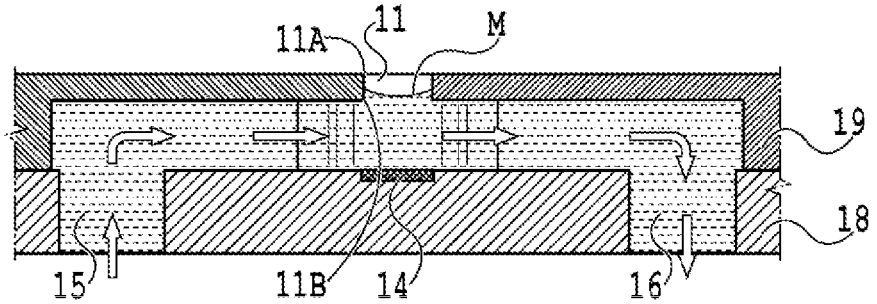
FIG. 4D is an explanatory diagram of an example configuration of an ejection orifice in another embodiment of the present invention.
Figure 4E:
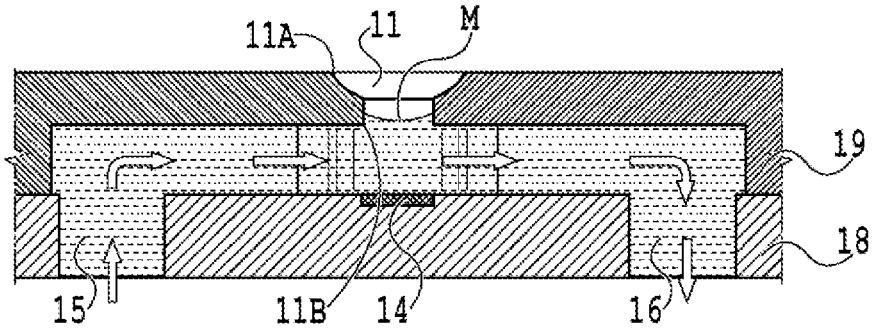
FIG. 4E is an explanatory diagram of an example configuration of an ejection orifice in another embodiment of the present invention.

The shapes of the ejection orifices 11 in the embodiments of FIGS. 4C, 4D, and 4E are similar to those in the first embodiment, the embodiment of FIG. 4A, and the embodiment of FIG. 4B, respectively. In these embodiments, with the water repellency of the inner surface of the ejection orifice 11, a meniscus M is formed at a position where the meniscus M slightly enters the ejection orifice 11 from its bottom 11B. The thickening of ink in the ejection orifice 11 is suppressed even in the case where the meniscus M is formed to slightly enter the ejection orifice 11 as described above. The meniscus M is located within a 3-μm range inside the ejection orifice 11 from the bottom 11B, as mentioned earlier.

Figure 5A:
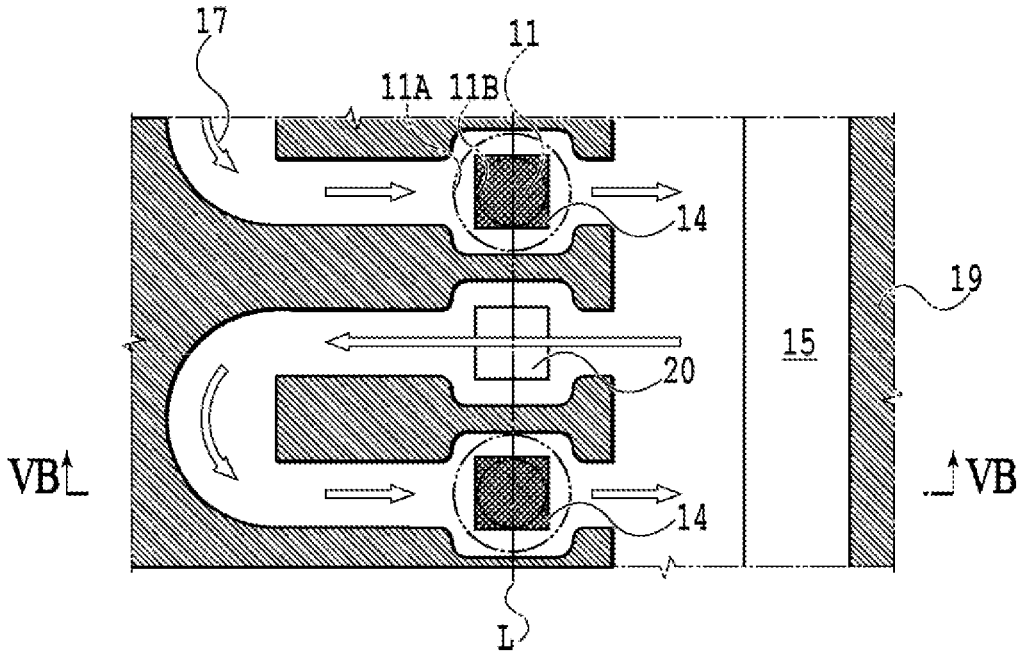
FIG. 5A is an explanatory diagram of an example configuration of ejection orifices in another embodiment of the present invention.
Figure 5B:
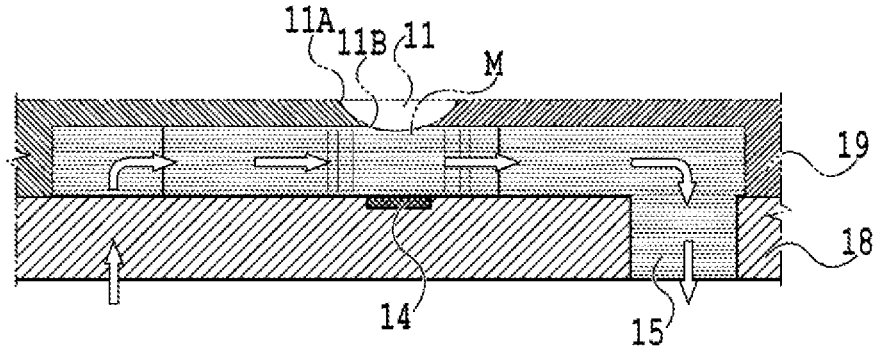
FIG. 5B is an explanatory diagram of the example configuration of the ejection orifices in the other embodiment of the present invention.

FIGS. 5A and 5B are diagrams for explaining still another embodiment of the present invention. In this embodiment, each channel 13 is formed in a U-shape with both ends communicating with a supply channel 15. FIG. 5A is an enlarged plan view similar to FIG. 1B, and FIG. 5B is a cross-sectional view along line VB-VB in FIG. 5A A micropump 22 that generates an ink circulatory flow as shown by the arrows in FIG. 5A is installed in a portion of a substrate 18 where one end portion 13A of the U-shaped channel 13 is formed. A pressure chamber 12 is formed at the other end portion 13B of the channel 13. A heater 14 is installed in the substrate 18 and an ejection orifice 11 is formed in the orifice plate 19 at a position corresponding to the pressure chamber 12. The shape of the ejection orifice 11 is similar to that in the first embodiment. With the water repellency of the inner surface of the ejection orifice 11, a meniscus M is formed at its bottom 11B. The thickening of ink in the ejection orifice 11 is suppressed as in the foregoing embodiments by generating an ink circulatory flow in the U-shaped channel 13 with the micropump 22 and also forming a meniscus M at the bottom 11B of the ejection orifice 11 as mentioned above.

(Example Configuration of Inkjet Printing Apparatus)

Figure 6A:
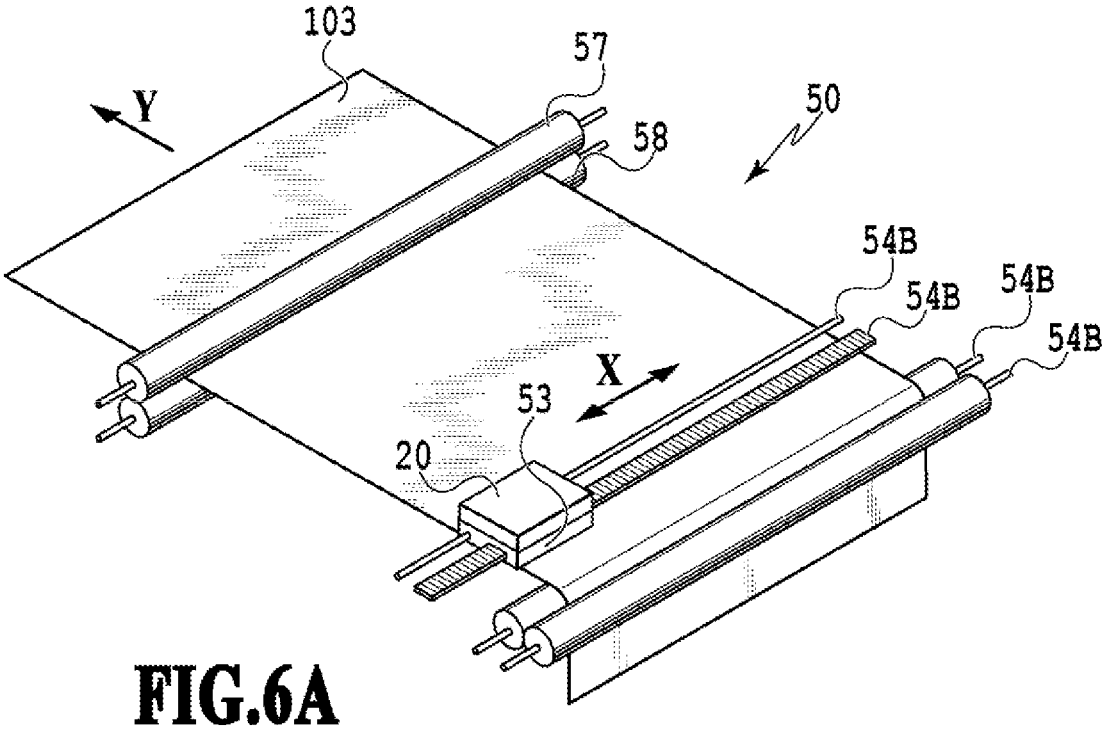
FIG. 6A is an explanatory diagram of an example configuration of a liquid ejection apparatus of the present invention.

The print head (liquid ejection head) 20 in each of the above embodiments can be used in various inkjet printing apparatuses (liquid ejection apparatuses) such as so-called serial scan-type and full line-type inkjet printing apparatuses. FIG. 6A is an example configuration of a serial scan-type inkjet printing apparatus in which the print head 20 in one of the above embodiments is detachably mounted on a carriage 53 that moves in the direction of arrow X in FIG. 8A (main scanning direction). The carriage 53 is guided by guide members 54A and 54B, and a print medium P is conveyed by rolls 55, 56, 57, and 58 in the direction of arrow Y (sub scanning direction). An image is printed onto the print medium P by repeating an operation of ejecting ink from the print head 20 while moving the print head 20 in the main scanning direction with the carriage 53 and an operation of conveying the print medium P in the sub scanning direction.

Figure 6B:
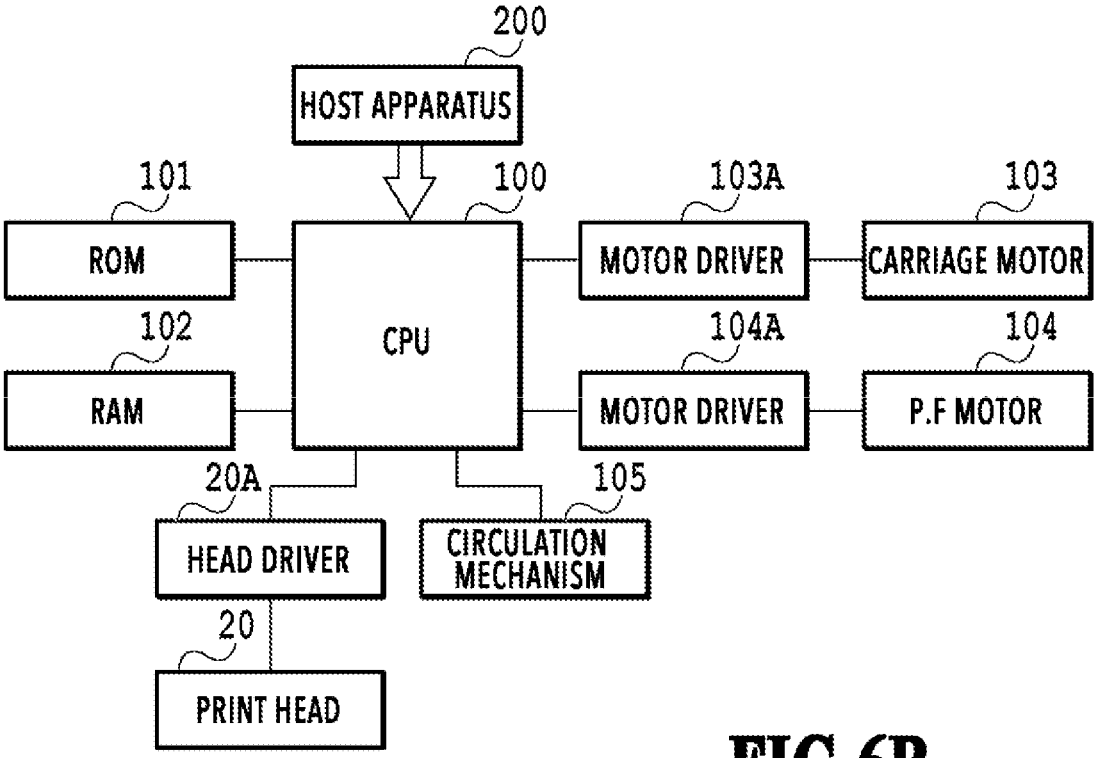
FIG. 6B is an explanatory diagram of an example configuration of the liquid ejection apparatus of the present invention.

FIG. 6B is a block diagram of a control system in the inkjet printing apparatus in FIG. 6A. A CPU (control unit) 100 executes processing of controlling the operation of the printing apparatus, data processing, and so on. A ROM 101 stores programs for procedures for these types of processing and so on, and a RAM 102 is used as a work area or the like for executing these types of processings. The heaters 14 in the print head 20 are driven via a head driver 20A. The printing of an image is performed by supplying driving data for the heaters 14 (image data) and driving control signals (heat pulse signals) to the head driver 20A. The CPU 100 controls a carriage motor 103 for driving the carriage 53 in the main scanning direction via a motor driver 103A, and controls a PF motor 104 for conveying the print medium P in the sub scanning direction via a motor driver 104A. The CPU 100 also controls a circulation mechanism 105 including micropumps or the like to cause ink to flow in the channels 31 through the pressure chambers 12, as described earlier.

The present invention is not limited only to inkjet print heads and inkjet printing apparatuses as described in the above embodiments, but is widely applicable as liquid ejection heads, liquid ejection apparatuses, and liquid ejection methods capable of ejecting various liquids. The liquid ejection head and the liquid ejection apparatus of the present invention are applicable to apparatuses such as printers, copying machines, machines with a communication system, and word processors with a printer unit, and further to industrial printing apparatuses integrally combined with various processing apparatuses. The present invention can be used in applications such as fabrication of a biochip and printing of an electronic circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-237195 filed Dec. 19, 2018, which is hereby incorporated by reference herein in its entirety.

What is claimed is:

1. A liquid ejection head comprising:

a pressure chamber;

a channel in which a liquid is caused to flow through the pressure chamber;

an ejection orifice communicating with the pressure chamber; and an ejection energy generation element configured to eject the liquid in the pressure chamber from the ejection orifice, wherein even in a case in which the ejection energy generation element does not perform an ejection operation, a meniscus of the liquid is formed at an end portion of the ejection orifice communicating with the pressure chamber.

2. The liquid ejection head according to claim 1, wherein at least part of an inner surface of the ejection orifice is water repellent.

3. The liquid ejection head according to claim 1, wherein the ejection orifice includes one end open to an inside of the pressure chamber and another end open to an outside, and the end portion of the ejection orifice is a portion in a range of 3 μm inside the ejection orifice from the one end.

4. The liquid ejection head according to claim 1, wherein the ejection orifice includes one end open to an inside of the pressure chamber and another end open to an outside, and an opening of the one end of the ejection orifice and an opening of the other end of the ejection orifice are different in size.

5. The liquid ejection head according to claim 1, further comprising a supply channel and an outlet channel for the liquid, wherein the channel is formed between the supply channel and the outlet channel.

6. The liquid ejection head according to claim 5, wherein a plurality of the pressure chambers are provided, and the channel allows at least one of the supply channel and the outlet channel to communicate with the plurality of pressure chambers.

7. The liquid ejection head according to claim 5, wherein a plurality of the pressure chambers are provided, a plurality of the supply channels and a plurality of the outlet channels are provided respectively for the plurality of pressure chambers, and a plurality of the channels allow the plurality of pressure chambers to communicate respectively with the supply channels and the outlet channels for the plurality of pressure chambers.

8. The liquid ejection head according to claim 1, further comprising:

a supply channel for the liquid communicating with one end and another end of the channel; and a unit configured to generate a flow of the liquid in the channel from the one end toward the other end.

9. The liquid ejection head according to claim 8, wherein the channel is in a U-shape.

10. The liquid ejection head according to claim 8, wherein the unit is a micropump.

11. A liquid ejection apparatus comprising:

the liquid ejection head according to claim 1;

a supply unit configured to supply the liquid into the channel of the liquid ejection head;

and a control unit configured to control the ejection energy generation element.

12. A liquid ejection method comprising:

causing a liquid to flow through a pressure chamber with which an ejection orifice communicates, and forming a meniscus of the liquid at an end portion of the ejection orifice communicating with the pressure chamber even in a case in which an ejection energy generation element configured to eject the liquid in the pressure chamber from the ejection orifice does not perform an ejection operation; and driving the ejection energy generation element to eject the liquid in the pressure chamber from the ejection orifice in a state in which the liquid is caused to flow and the meniscus is formed.

* * * * *